US006494187B2

(12) United States Patent
Giavi et al.

(10) Patent No.: US 6,494,187 B2
(45) Date of Patent: Dec. 17, 2002

(54) ARRANGEMENT AND METHOD FOR CONTROLLING A CONTROL VALVE FOR A DIESEL INJECTION SYSTEM

(75) Inventors: Raimondo Giavi, Munich (DE); Reda Rizk, Cologne (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/944,498

(22) Filed: Aug. 31, 2001

(65) Prior Publication Data

US 2002/0029765 A1 Mar. 14, 2002

Related U.S. Application Data

(63) Continuation of application No. PCT/DE00/00521, filed on Feb. 24, 2000.

(30) Foreign Application Priority Data

Mar. 1, 1999 (DE) ..... 199 08 812

(51) Int. Cl.[7] ..... F02M 51/00
(52) U.S. Cl. ..... 123/490; 123/478; 251/129.04
(58) Field of Search ..... 123/490, 478; 251/129.04, 129.1

(56) References Cited

U.S. PATENT DOCUMENTS

| | | | | |
|---|---|---|---|---|
| 4,519,351 A | | 5/1985 | Archer | 123/357 |
| 4,793,313 A | | 12/1988 | Paganon et al. | 123/506 |
| 5,311,903 A | * | 5/1994 | Poulin | 123/506 |
| 5,460,329 A | | 10/1995 | Sturman | 239/96 |
| 5,592,921 A | * | 1/1997 | Rehbichler | 123/490 |
| 5,640,987 A | | 6/1997 | Sturman | 137/1 |
| 5,720,261 A | | 2/1998 | Sturman et al. | 123/446 |
| 5,992,391 A | * | 11/1999 | Yamakado et al. | 123/490 |
| 6,152,094 A | * | 11/2000 | Kirschbaum | 123/90.11 |

FOREIGN PATENT DOCUMENTS

| | | |
|---|---|---|
| DE | 3302292 | 7/1984 |
| DE | 19723563 | 12/1998 |

* cited by examiner

*Primary Examiner*—John Kwon
(74) *Attorney, Agent, or Firm*—Baker Botts LLP

(57) ABSTRACT

The apparatus and method of regulating a control valve for a Diesel injection system comprises a fuel injector having a pressure amplifier preceded by the control valve (10), the slide (20) of the control valve (10) being moved by two spatially separated magnet coils (30, 32). During an electrical triggering of one of the two magnet coils (30, 32) with a control current, the respective other magnet coil (32, 30) is switched as a sensor, detecting the current induced in the sensor by a motion of the valve slide (20).

6 Claims, 2 Drawing Sheets

ARRANGEMENT AND METHOD FOR CONTROLLING A CONTROL VALVE FOR A DIESEL INJECTION SYSTEM

This is a continuation of copending application Serial No. PCT/DE00/00521 filed Feb. 24, 2000, PCT Publication WO 00/52326, which claims the priority of DE 199 08 812.8 filed Mar. 1, 1999.

FIELD OF THE INVENTION

The present invention relates to an arrangement and a method for controlling a control valve for a diesel injection system.

BACKGROUND OF THE INVENTION

A control valve arrangement and method for controlling the same are disclosed in U.S. Pat. No. 5,640,987. Diesel engines with direct injection have the highest thermodynamic efficiency of all internal combustion engines. In terms of fuel injection, different technologies are in use for different engines. Particularly in the commercial vehicle sector, systems with pressure transmission for generating higher pressures have become standard practice. An example of a fuel injector with pressure transmission is described in U.S. Pat. No. 5,460,329 (Sturman). Here, the fuel is fed to a pressure booster in the injector via an electromagnetic control valve which is embodied as a slide valve. The fuel is placed under high pressure by the pressure booster at fixed times or crank angles by means of the electromagnetic actuation of the control valve. The fuel which is placed under high pressure then causes the valve needle of the injector to lift off from its seat and clear the path for the fuel to be injected from the injection nozzle of the injector into the combustion space of the diesel engine.

The control valve has in each case one electromagnet in the region of each of the two ends of the valve slide in order to be able to be switched back and forward without elastic restoring elements being necessary. However, in order to keep the control valve in a defined position, current must continue to be supplied to one of the two magnets even after the desired position has already been reached.

For this reason, Sturman developed the electromagnetic control valve in the way described in U.S. Pat. No. 5,640,987. In this refinement, the valve slide and the housing of the control valve are composed of suitable magnetic materials so that even without current the valve slide remains in the respective limit position owing to the hysteresis of the magnetic material of the slide. For switching over, all that is necessary is for current to be briefly supplied to one of the two solenoids. After the switching over has occurred the current can then be switched off. This type of control valve is referred to as a digital valve owing to its bistable behavior. The valve can be embodied as a 2-way, 3-way or 4-way valve.

Such a control valve is also described in U.S. Pat. No. 5,720,261. The feeding of current to the actuated solenoid is interrupted as soon as the control valve is in a limit position. To do this, the non-actuated solenoid is used as a sensor which detects the end of the movement of the control valve.

However, unavoidable fabrication tolerances and thus the inevitably different pairing interplay between the valve slide and the valve housing at the control valves of the individual injectors of an injection system for a multicylinder engine and differences in the masses of the valves and difficulties in the valve setting bring about a different injection behavior of the individual injectors at the different cylinders of the engine, and as a consequence non-uniform behavior of the engine, in particular through running problems.

SUMMARY OF THE INVENTION

The object of the present invention is to configure the control valve in such a way that the wide-ranging variation of the injectors in terms of injection behavior is reduced and the engine runs in a better and more uniform way. The object of the present invention is achieved according to the invention in that while current is supplied to one of the two solenoids of the control valve in order to generate a magnetic force, the other solenoid of the respective control valve is switched as a sensor for a movement of the valve slide. Because the valve slide is composed of a magnetic material, the magnetic properties and the hysteresis properties of this material permit a movement of the valve slide while the control current is acting, and even after it has been switched off, induces a current or a voltage for the one solenoid in the sensor. The information which is obtained in this way during a number of operating cycles about the characteristic response behavior of the control valve when actuation occurs can be processed within the scope of an intelligent control in such a way that the injection behavior of the respective injector is improved to the effect that deviations from the individual setpoint values of the injection parameters are reduced. For example, a relatively long dead time between the start of the energization of the solenoid and the start of the movement of the valve slide in the case of a control valve, or generally a delayed switching behavior as a result of an earlier start of the energization or a different voltage supply can be compensated.

Even if the two electromagnets are connected in parallel during operation in order to increase the speed, it is possible to determine, within a short time and from a small number of cycles of the switching operation with just one activated magnet, the characteristic behavior of the valve with a sufficient precision to approximate the actual behavior to the desired behavior by means of appropriate measures.

The arrangement and method according to the present invention have the advantage that no additional components are required on the injector such as a stroke sensor and the like. The method according to the present invention can, for example, be carried out relatively easily by means of suitable software in the existing electronic engine controller. The application as originally filed in German is incorporated herein by reference.

DRAWINGS

An embodiment of the present invention is explained in more detail below and with reference to the drawings, in which.

DETAILED DESCRIPTION OF THE INVENTION

Figure 1:
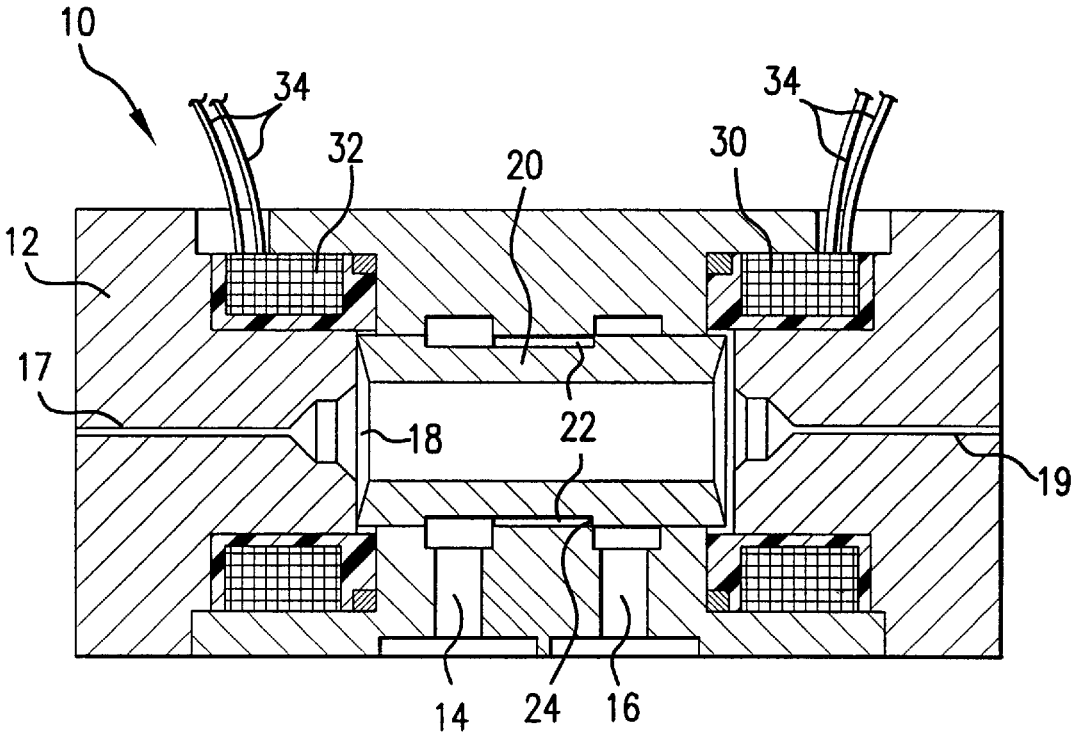
FIG. 1 shows a section through a control valve.

FIG. 1 shows a schematic sectional view of the control valve disclosed in U.S. Pat. No. 5,640,987. Such a control valve is used to control the timing of the flow of a fluid to the pressure booster of a fuel injector in order to increase the pressure in a pressure chamber in the injector. The fuel in the pressure chamber is then injected into the combustion chamber of the internal combustion engine via the injection nozzles. The control valve can be embodied as a 2-way, 3-way or 4-way valve.

The control valve 10 shown in FIG. 1 has a housing 12 with a first opening 14 and a second opening 16. The openings 14, 16 open into a valve chamber 18 in the housing 12. The fuel is fed in from a fuel accumulator via the opening 14. The opening 16 forms the connection to the pressure booster of the injector.

A valve slide 20 having a circumferential groove 22 is inserted in an axially movable fashion into the valve chamber 18. The valve slide 20 can move backward and forward between a left-hand limit position, as shown in FIG. 1; and a right-hand limit position (not shown). In order to prevent damping of the movement of the valve slide 20, the housing 12 has a first leakage opening 17 and a second leakage opening 19, each end of which is an end face of the valve chamber 18 and is held in a non-pressurized state.

Groove 22 is also located opposite the two openings 14, 16 in such a way that the control edge 24 formed by the lateral boundary of the groove 22 blocks the fluid connection between the openings 14, 16 when the valve slide 20 is in the left-hand limit position, while the fluid connection is cleared in the other, right-hand limit position of the valve slide 20. The limit position of the valve slide 20 which is on the left in FIG. 1 is thus the closed position and the opposite right-hand limit position of the valve slide 20 is the open position of t he control valve 10.

The control valve 10 also comprises a first solenoid 30, and a second solenoid 32 which is spatially separated from the first. This means that one solenoid 30, 32 (for generating magnetic forces for a movement of the valve slide 20) is provided in the region of each of the two axial ends of the valve slide 20 in the housing 12 of the control valve 10. The first solenoid 30 is arranged on the right-hand side of the valve chamber 18 as shown in FIG. 1 and moves the valve slide 20 into the right-hand limit position (the open position), while the second solenoid 32 is arranged on the left-hand side of the valve chamber 18 and is provided for moving the valve slide 20 into the left hand limit position (the closed position ). The feeder lines 34 to the solenoids 30, 32 are connected to an electrical control circuit (not shown).

In order to open the control valve 10 so that a fluid, i.e., the fuel, can flow from the first opening 14 to the second opening 16 and thus from the accumulator to the pressure booster in the fuel injector, a control current is supplied to the first solenoid 30 by the electrical control circuit. After the valve slide 20 has reached the right-hand limit position, owing to the magnetic force which is thus acting on it, the current for the first solenoid 30 is switched off. The valve slide 20 and the housing 12 of the control valve 10 are composed of suitable magnetic material so that, even without current in the first solenoid 30, the valve slide 20 remains in the right-hand limit position, the open position, owing to the magnetic hysteresis. The control valve 10 is closed by virtue of the fact that a control current is supplied to the second solenoid 32 for a specific time so that a magnetic force acts on the valve slide 20 and moves it into the left-hand closed position.

According to the present invention, while one of the two solenoids 30, 32 is electrically actuated with a control current, the other solenoid 32, 30 is switched as a sensor and the current (or the induced voltage) which is induced in the sensor as a result of a movement of the valve slide 20 is sensed in the control circuit and evaluated in order to determine the response behavior of the respective control valve 10. This means that while a control current is fed to the first solenoid 30, the second solenoid 32 is switched and used as a sensor for a movement of the slide 20. The current (or the induced voltage) which is induced by a movement of the valve slide 20 is sensed at the second solenoid 32. In the same way, if a control current is fed to the second solenoid 32, the first solenoid 30 is used and switched as a sensor. In this way, it is possible to acquire pieces of the following information which are correlated with one another:

- chronological dependence of the current through the respectively energized solenoid;
- chronological dependence of the movement of the valve slide 20 which is brought about as a result; and
- time when the respective limit position of the valve slide 20 is reached.

Figure 2:
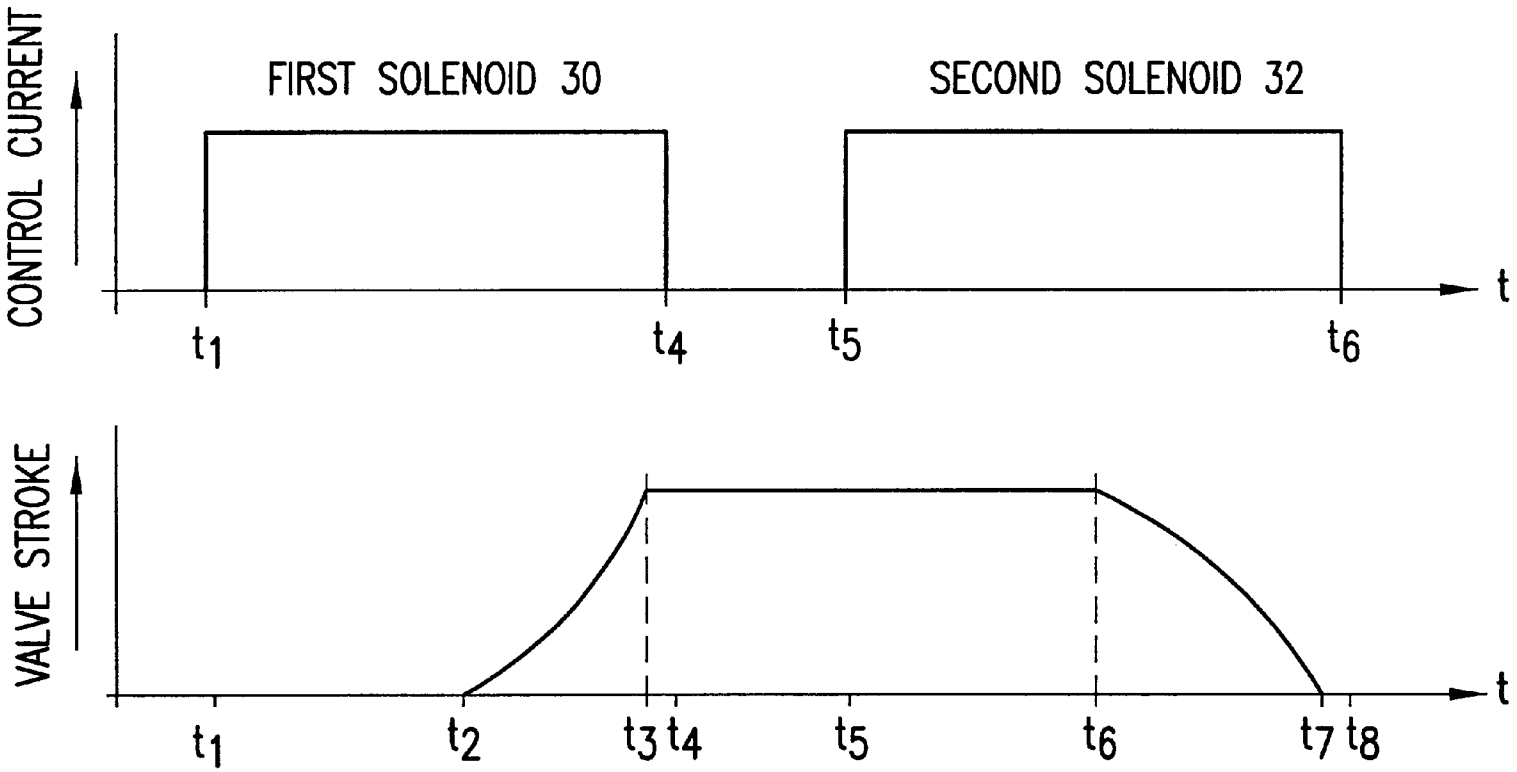
FIG. 2 shows the control valve stroke as a function of the time and/or the crank angle when the control valve in FIG. 1 is electromagnetically actuated.

FIG. 2, in the upper part, ideally shows the variation over time of the control current (unbroken line) fed to the first solenoid 30, and the variation over time of the control current (dashed line) fed to the second solenoid 32. The actual profile of the current differs from the illustrated ideal profile in order to simplify the explanation and can be used to determine the characteristic response behavior of the control valve.

In the lower part of FIG. 2, the valve stroke of the valve slide 20 is shown in chronological correlation with the upper part. At time $t_1$, in order to open the control valve 10 from its normally closed position, the energization of the first solenoid 30 by the control circuit is started. Then, at time $t_2$, the valve slide 20 begins, with a certain delay, to move in the direction of the right-hand limit position, i.e., the open position. This start of the movement is sensed by the second solenoid 32 switched in a sensor mode at this time, owing to the current or voltage induced in the second solenoid 32. If the valve slide 20 comes to bear in its right-hand limit position (the open position) and therefore no longer moves, it does not induce any current or voltage in the second solenoid 32. This results precisely in time $t_3$, in which the valve slide 20 comes to bear in its right-hand limit position. As a consequence of this, the current for the first solenoid 30 can be switched off directly afterwards at the time $t_4$.

In order to close the control valve 10, current is fed to the second solenoid 32 by the control circuit starting from time $t_5$, while the first solenoid 30 is switched in a sensor mode. The first solenoid 30 then senses time $t_6$ of the start of the movement of the valve slide 20 to the left in the direction of the left-hand (closed) limit position, and time $t_7$ when the valve slide 20 comes to bear in the left-hand (closed) limit position. T he energization of the second solenoid 32 is then ended at time $t_8$.

Time $t_2$ defines the start of injection and time period from $t_2$ to $t_7$ determines essentially the injection period of the injector. The delay time $t_2-t_1$ between the start of the energization of the first solenoid valve 30 in order to open the valve and the actual opening as well as the switch-off time $t_7-t_5$ between the start of the energization of the second solenoid valve 32 in order to switch off the valve, and the actual switching off, thus influence the most important injection parameters of the injector. Because the times $t_1$ to $t_8$ can be registered precisely at each injector with the present invention and the present method, the delay times $t_2-t_1$, and the switch-off times $t_7-t_5$ during the electrical actuation of each individual injector on the engine can be taken into account, for example, by suitably defining the times $t_1$ and $t_5$ in relation to the crank angle so that deviations from the setpoint value or average value can be precisely compensated. Alternatively, or additionally, it is of course also possible to change the intensity of the current and/or the voltage of the control current and the like in order to compensate deviations.

The times $t_1$ to $t_8$ each correspond to a specific crank angle of the engine. For this reason, the provision of information on the times can also be replaced during the sensing of the rotational speed by information relating to the respective crank angle.

The present invention and the present method can be used even if, in order to increase the switching speed, both solenoids 30, 32 are generally operated in parallel. In order to define the times $t_1$ to $t_8$, all that is necessary is to carry out separately just a small number of cycles with just one actively actuated magnet each, while the other magnet is used, as described, as a sensor. In this way, the actual behavior of the respective control valve can be identified sufficiently precisely to enable it to be adapted to the setpoint behavior by adjusting, for example, the start of the energization and/or the intensity of the controlled current.

We claim:

1. A control arrangement for controlling a control valve for a fuel injection system comprising a fuel injector with a pressure booster, wherein the control valve is connected upstream of the fuel injector, the control valve comprising a housing having a valve chamber with a movable valve slide and a first solenoid and a second solenoid for moving a valve slide, and wherein one of the two solenoids is electrically actuated with a control current and the other solenoid is switched as a sensor, and the current is induced in the sensor by a movement of the valve slide being registered in a control circuit during a number of operating cycles of the fuel injector, and evaluated in order to determine the response behavior of the control valve, further wherein the specific response behavior after the number of operating cycles is used to control the control valve.

2. The control arrangement according to claim 1, wherein, in order to determine the response behavior of the control valve during a number of operating cycles of the fuel injector, only one of the solenoids is electrically actuated and the other solenoid is switched as a sensor, and during all other operating cycles of the fuel injector the two solenoids are actuated in parallel.

3. A method for controlling a control valve for a diesel injection system having a fuel injector with a pressure booster, upstream of which the control valve is connected, the control valve having a housing with a valve chamber with a movable valve slide and a first solenoid and a second solenoid for moving the valve slide, comprising electrically actuating one of the two solenoids with a control current, causing the other solenoid to be used as a sensor, wherein a current which is induced in the sensor by a movement of the valve slide is sensed and evaluated in order to determine the response behavior of the control valve, and further wherein a specific response behavior is used to control the control valve after a number of operating cycles of the fuel injector.

4. The method according to claim 3, wherein, in order to determine the response behavior of the control valve during a number of operating cycles of the fuel injector, only one of the solenoids is electrically actuated and the other solenoid is switched as a sensor, and during all other operating cycles of the fuel injector the two solenoids are actuated in parallel.

5. The method according to claim 3, wherein, in order to adjust the response behavior of the control valve, the time of the start of the feeding of the control current to the actuated solenoid is changed.

6. The method according to claim 3, wherein, in order to adjust the response behavior of the control valve, the intensity of the control current for the actuated solenoid is changed.

* * * * *